US006566773B2

(12) United States Patent
Trimborn et al.

(10) Patent No.: US 6,566,773 B2
(45) Date of Patent: May 20, 2003

(54) BEARING HOUSING FOR A DRIVE DEVICE OF A CHEESE-PRODUCING TEXTILE MACHINE

(75) Inventors: Detlev Trimborn, Mönchengladbach (DE); Christian Sturm, Krefeld (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/932,176

(22) Filed: Aug. 17, 2001

(65) Prior Publication Data

US 2002/0021851 A1 Feb. 21, 2002

(30) Foreign Application Priority Data

Aug. 17, 2000 (DE) ..... 100 40 109

(51) Int. Cl.[7] ..... H02K 5/08; H02K 5/16

(52) U.S. Cl. ..... 310/89; 310/64; 310/52; 310/90; 242/366.4; 242/390.8

(58) Field of Search ..... 310/64, 89, 90, 310/91, 52; 242/366.4, 390, 390.2, 390.7, 390.8, 390.9, 486.6, 564; 57/100

(56) References Cited

U.S. PATENT DOCUMENTS

| | | | | |
|---|---|---|---|---|
| 3,792,329 A | | 2/1974 | Kuhnlein | 318/210 |
| 3,972,171 A | * | 8/1976 | Handschuch et al. | 24/279 |
| 4,112,663 A | | 9/1978 | Chrtek et al. | 57/58.89 |
| 4,420,926 A | * | 12/1983 | Remontet | 57/100 |
| 4,633,664 A | * | 1/1987 | Mueller-Storz et al. | 57/100 |
| 5,927,636 A | | 7/1999 | Rafflenbeul | 242/470 |
| 6,148,596 A | * | 11/2000 | Kimura et al. | 310/68 R |
| 6,232,732 B1 | | 5/2001 | Haasen et al. | 318/375 |

FOREIGN PATENT DOCUMENTS

| | | |
|---|---|---|
| DE | 2106 898 | 8/1972 |
| DE | 27 14299 C2 | 1/1978 |
| DE | 214 114 | 10/1984 |
| DE | 198 36 701 A1 | 2/2000 |
| DE | 198 58 548 A1 | 6/2000 |
| DE | 199 08 093 A1 | 8/2000 |
| EP | 0 845 432 A1 | 6/1998 |
| JP | 05111211 | 4/1993 |
| JP | 10194591 | 7/1998 |
| JP | 10194591 A | 7/1998 |
| JP | 11089165 | 3/1999 |

OTHER PUBLICATIONS

German Search Report.

* cited by examiner

*Primary Examiner*—Burton S. Mullins
(74) *Attorney, Agent, or Firm*—Kennedy Covington Lobdell & Hickman, LLP

(57) ABSTRACT

A bearing housing (23) for a drive device (27) integrated in a creel (18) of a cheese-producing textile machine, which brakes the cheese (11) via a braking current directed opposite the nominal rated current of the drive device. The bearing housing (23) has a plurality of cooling ribs (33), whose exterior is covered with a material having a low heat conductivity (8).

8 Claims, 2 Drawing Sheets

BEARING HOUSING FOR A DRIVE DEVICE OF A CHEESE-PRODUCING TEXTILE MACHINE

CROSS-REFERENCES TO RELATED APPLICATIONS

This application claims the benefit of German patent application DE P 10040109.0 filed Aug. 17, 2000, herein incorporated by reference.

FIELD OF THE INVENTION

The present invention relates to a bearing housing for a drive device for a creel of a cheese-producing textile machine and, more particularly, to such a bearing housing for an electromotor drive device which is integrated into the creel and can be loaded or charged with a braking current counter to the nominal rated current of the drive device for braking the cheese.

BACKGROUND OF THE INVENTION

Drive devices which are arranged on the creel are known in particular in connection with bobbin winding devices which were developed for producing cheeses of the "precision winding", or "stepped precision winding" types.

Subsequently published German Patent Publication DE 199 08 093.3, for example, describes a bobbin winding device in which a cheese held in a creel is directly driven by a drive motor integrated into the creel. The cheese rests on a pressure roller that is not driven itself. Traversing of the yarn to be wound takes place by means of a finger-like yarn guide operated by a separate drive. The two drives can be controlled via an appropriate control device such that a defined, pre-selectable winding ratio is always obtained.

Since it is necessary to stop a cheese frequently in the course of the overall process of winding yarn onto the cheese, for example, when a yarn supply cop is exhausted, upon a yarn break, or following a controlled cutting of the yarn via a yarn cleaner, the known winding device also comprises a pneumatically loadable braking device integrated into the creel. This known braking device is comprised of a brake lining fixed on the stator housing of the electromotor to rotate in unison with the housing, against which a contact surface of a tube receiving plate, embodied as a brake disk, can be pneumatically pressed. The braking force thereby produced rapidly brings the cheese to a stop.

However, this known cheese winding device has a number of disadvantages which have prevented the device from becoming accepted in actual use. Both the rotating brake disk and the stationary brake lining are subjected to significant wear and therefore the braking device requires intensive maintenance. In addition, the brake dust created can readily enter into the axial sliding guide of the cheese drive as well as into the bearing of the electromotor and considerably hampers the functioning or may even cause breakdown of these components.

Other cheese winding devices are known, for example from German Patent Publication DE 198 36 701 A1, in which a grooved drum that drives the cheese and at the same time traverses the yarn is electrically braked to a standstill after the cheese has been lifted off. To this end, the drive motor of the grooved drum is loaded or charged with a braking current that is usually a multiple of the nominal rated current of the drive motor. In the process, the drive motors of such cheese winding devices are subjected to considerable loads, especially when large cheeses must be repeatedly braked and accelerated at short time intervals. For this reason, the dimensions of the drive motors are made quite large, in particular for preventing overheating, and as a rule are correspondingly heavy.

It is known from German Patent Publications DE 21 06 898 A1 or German Patent DD 214,114 that textile machine drive devices which are subjected to large thermal loads can be provided with cooling ribs so that the motor heat can be removed via convection and radiation into the ambient environment. Alternatively, as described in German Patent DE 27 14 299 C2, such drive devices can be cooled by a permanent application of compressed air.

As already mentioned above, these known drive devices are comparatively large, bulky and heavy, especially when correspondingly large output data are demanded. However, drive devices which are intended to be integrated directly into the creel of a cheese-producing textile machine must be as small and lightweight as possible, since during the winding process their weight results in an additional unwanted load on the rotation of the cheese on the associated pressure roller.

Such relatively small drive devices are correspondingly greatly stressed during operation. Thus, the motors often become very hot, including the area of their motor housing. Accordingly, in the interest of promoting sufficient cooling, the motor housing is arranged to be exposed to the ambient environment, but as a result the unintentional touching of this component by the machine operators cannot always be avoided. Therefore there is the constant danger of the operators being injured by burns from these components.

SUMMARY OF THE INVENTION

In view of the above described state of the art, the present invention seeks to address the problem of providing a bearing housing for a drive device integrated in a creel which, on the one hand, permits sufficient cooling of the drive device and, on the other hand, minimizes the danger of injuries to the operators.

The present invention is addressed by providing a bearing housing for a drive device integrated in a creel of a cheese-producing textile machine, wherein the drive device is loadable with a braking current counter to the nominal rated current of the drive device for braking the cheese. In accordance with the present invention, the bearing housing comprises a plurality of cooling ribs each having an exterior covered with a material having a low heat conductivity.

This design of the bearing housing in accordance with the present invention assures that, by insulating the areas of accessible cooling ribs with a material of poor heat conductivity, these danger areas for the operators are defused. Accordingly, it is assured that the outer areas of the cooling ribs can no longer become so hot, even at extremely high motor temperatures, that there would be a danger of being burned by these components.

Because of the defusing of the critical bearing housing area, the drive devices can be operated at higher motor temperatures. The surface temperature in the lower, uncovered cooling rib areas of the bearing housing rises because of the increased motor heat of the drive devices, which results in a clearly increased heat transfer to the surroundings in these areas.

Thus, the present invention has the advantage that, in spite of a reduction of the cooling surface of the bearing housing, its cooling output is increased, and in the process the danger of injuries to the operators is simultaneously minimized.

In a preferred design, the caps of the cooling ribs of the bearing housing are made of a thermoplastic material, preferably polyamide. Since the heat conductivity of such a material is considerably less than the heat conductivity of, for example steel or aluminum, the cooling ribs in the areas in which they are accessible to the operators remain below a level critical for the operators, even at high motor temperatures. Thus, in their accessible areas the cooling ribs never become so hot that the danger of burning arises for the operators.

It is further preferred that the mutual spacing between the cooling ribs is selected to be such that an unintentional access to the unprotected intermediate hot portions of the cooling ribs is dependably prevented.

In a further alternative design, a sensor device is arranged in the area of the bearing housing. Such a sensor device allows the permanent monitoring of the existing bearing housing temperature and, when utilized in connection with an auxiliary cooling device, a directed intervention may be actuated if a critical motor temperature of the drive device should be reached.

In a preferred embodiment, the auxiliary cooling device, for example may be a compressed air device installed in the area of the bearing housing. This compressed air device, which can be activated as a result of an appropriate signal from the sensor device, can be temporarily connected with a compressed air source via a valve when the drive device has reached a critical temperature level. Thus, the auxiliary cooling device is actuated only under exceptional circumstances; under normal operations, the motor heat can be carried off via the cooling ribs by means of convection and radiation.

Further details, features and advantages of the present invention will be described and understood from an exemplary embodiment which is described hereinbelow with reference to the accompanying drawings.

DESCRIPTION OF THE PREFERRED EMBODIMENTS

Figure 1:
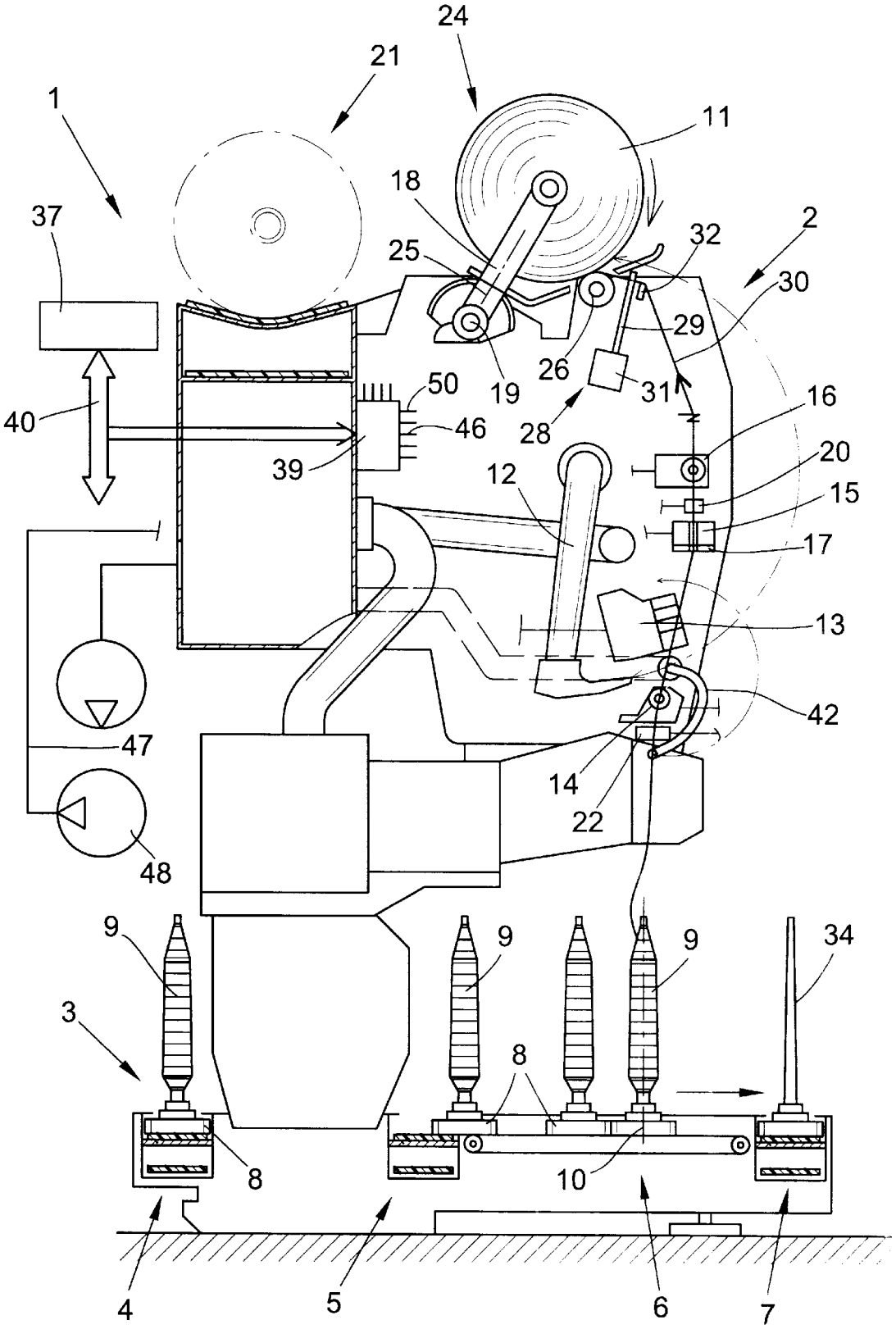
FIG. 1 is a partially schematic side elevational view of a work station of a cheese-producing textile machine, incorporating the bearing housing of the present invention.

Referring now to the accompanying drawings and initially to FIG. 1, a textile cheese-producing machine, preferably an automatic cheese winder in this exemplary embodiment, is schematically shown in a side elevational view and is designated in its entirety by reference numeral 1.

Such automatic cheese winders customarily comprise a plurality of similar work stations, in the present instance cheese winding stations 2, commonly referred to as winding heads, aligned with one another between the end frames (not shown) of the machine.

Textile yarn from spinning cops 9 manufactured on a ring spinning machine are rewound by these winding heads 2 onto large-volume cheeses 11 in a manner that is already known and therefore need not be explained in more detail. After the production of each cheese 11 has been completed, the cheese 11 is transferred onto cheese transport device 21 running the length of the machine, e.g., by pivoting creel 18 about pivot axis 19, and the cheese 11 is thereby transported to a bobbin loading station or the like (not shown) arranged at an end of the winding machine.

Additionally, such automatic cheese winders 1 customarily comprise a logistic device in the form of a bobbin and tube transport system 3. Spinning cops 9 and empty cop tubes 34 are supported on transport plates 8 in upstanding disposition and these transport plates 8 are circulated within the machine via various conveyor runs of this logistic device. FIG. 1 shows only the following parts of a known bobbin and tube transport system 3: Cop feed conveyor 4, storage conveyor 5, which can be driven in a reversing manner, one of transversal transport conveyor 6 running to winding heads 2 as well as tube return conveyor 7. The spinning cops 9 thusly transported are rewound to large-volume cheeses 11 at the unwinding position 10 located along each transversal transport conveyor 6 at the associated winding head 2.

As is known and therefore only schematically indicated, each individual winding head 2 comprises various devices that make possible an orderly operation of these work stations. As depicted in FIG. 1, a yarn 30 being rewound at the winding head 2 travels from spinning cop 9 to cheese 11 along a path adjacent which various operational devices are provided to perform various operations as a part of the winding process, e.g., a yarn suction nozzle 12, a yarn grasping tube 42, a splicing device 13, a yarn tensioning device 14, a yarn cleaner 15, a paraffin application system 16, a yarn cutting device 17, a yarn tension sensor 20 and an underyarn sensor 22.

Each winding head 2 includes a cheese winding device, designated in its entirety by reference numeral 24, which comprises creel 18 supported in such a manner that it can move about pivot axis 19. Creel 18 can also be pivoted about axis 25, e.g., to manufacture conical cheeses.

Figures 2, 3:
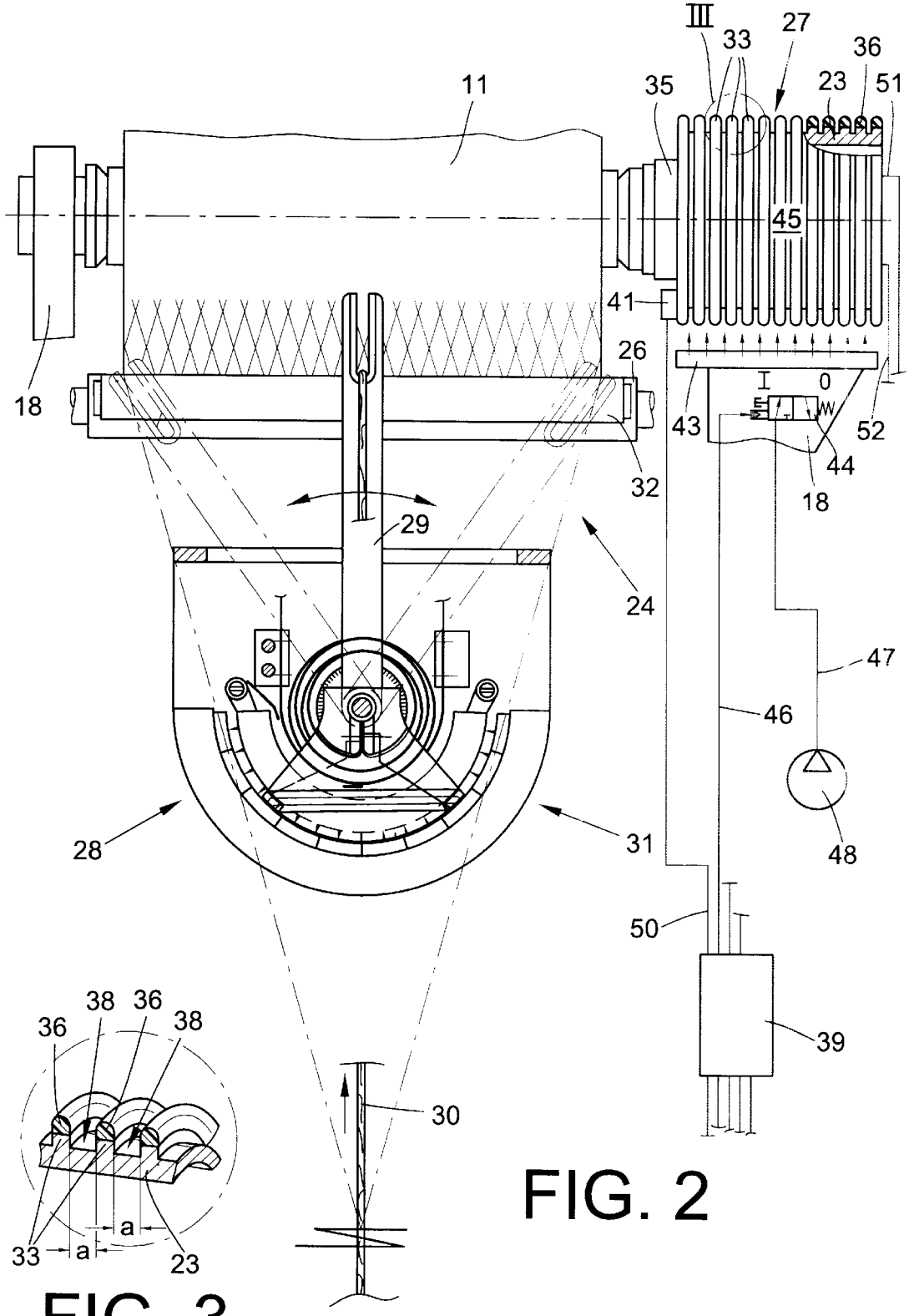
FIG. 2 is a front elevational view, partially in section, of the bobbin winding device of the work station represented in FIG. 1, with a drive device integrated in accordance with the invention into the bearing housing of the creel.
FIG. 3 is an enlarged detailed sectional view of the cooling ribs of the bearing housing of the present invention, as viewed from III in FIG. 2.

During the winding process, the driven cheese 11 rests with its surface on pressure roller 26 and frictionally entrains this pressure roller 26, that has no drive. The cheese 11 is driven via drive device 27 with speed control. This drive device 27, preferably embodied as an electronically commutated direct-current (d.c.) motor 45, is integrated in a bearing housing 23 of the creel 18, as represented in FIG. 2, and is connected via current conductors 51, 52 to a d.c. source (not represented).

Yarn traversing device 28 is provided to traverse yarn 30 during the winding process. Such a traversing device is only indicated schematically in FIG. 2 and is described in detail in German Patent Publication DE 198 58 548 A1. Yarn traversing device 28 is basically comprised of yarn guide 29 in the form of a finger which is loaded by electromechanical drive 31 to traverse yarn 30 between the two front sides of cheese 11, as indicated in FIG. 2. Yarn 30 glides during its displacement by yarn guide 29 on guide edge 32.

In addition, such bobbin winding heads have a bobbin winding head-specific control device, preferably embodied as a bobbin winding head computer 39, which coordinates the operating sequences of the above described devices, and which is connected via a machine bus 40 with a central control unit 37 of the automatic cheese winder 1.

The electronically commutated d.c. motor 45 of the drive device 27 is known and therefore is not shown in detail. As indicated in FIG. 2, the motor 45 is arranged in a sliding bushing 35, which is seated to be axially displaceable in a bearing housing 23. As represented in detail in FIG. 3, the bearing housing 23 has a plurality of cooling ribs 33, the exterior circumferences of which are covered with caps 36. The caps 36 are preferably formed by coating the ribs with a suitable material, preferably a material of low heat conductivity, such as polyamide.

The mutual spacing a between the cooling ribs 33, which themselves are made of a material of good heat conductivity, for example steel or aluminum, is selected such that an unintentional touching of the surfaces of the cooling ribs 33 not covered by the caps 36 and the cooling rib bottoms 38 therebetween is impossible.

As furthermore represented in FIG. 2, a sensor device 41 can additionally be installed in the area of the bearing housing 23, which continuously detects the temperature of the bearing housing 23. The signals from the sensor device 41 are transmitted to the bobbin winding head computer 39 via a signal line 50, where the signals are appropriately processed.

An auxiliary cooling device 43, preferably operating pneumatically, can also be arranged in the area of the bearing housing 23, and is connected via a directional control valve 44 and a pneumatic line 47 to a source of pressurized air 48. The directional control valve 44 is electronically switchable when required under the control of the bobbin winding head computer 39 via a signal line 46.

Thus, during normal ongoing winding operations, the motor heat from the drive device 27, which is mainly generated during braking and acceleration, is dissipated via the uncapped areas of the cooling ribs 33 to the surroundings. Because of their low heat conductivity, the caps 36 arranged on the cooling ribs 33 prevent the operators from possibly being burned by the cooling ribs 33, which become relatively hot particularly in the uncapped areas.

In special cases, when the motor temperature exceeds a threshold value, which is detected via the sensor device 41, it is additionally possible to activate the auxiliary cooling device 43 via the directional control valve 44. In these cases, an effective cooling air flow is blown over the bearing housing 23 by means of the auxiliary cooling device 43, which is thereby considerably cooled.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A cheese-winding textile machine comprising a creel for supporting a year cheese during a winding operation, a drive device selectively operable at a nominal rated current for driving the cheese and at a braking current opposite to the nominal rated current for braking the cheese, a housing integral with the creel for supporting the drive device, the housing comprising a plurality of cooling ribs each having an exterior covered with a material having a low heat conductivity.

2. A cheese-winding textile machine in accordance with claim 1, characterized in that the cooling ribs of the housing are covered by caps made of a thermoplastic material.

3. A cheese-winding textile machine in accordance with claim 2, characterized in that the thermoplastic material is polyamide.

4. A cheese-winding textile machine in accordance with claim 1, characterized in that a mutual spacing is provided between the cooling ribs to deter touching of the uncovered portions of the cooling ribs and the housing.

5. A cheese-winding textile machine in accordance with claim 1, characterized in that a sensor device is arranged in the area of the housing to monitor the temperature thereof.

6. A cheese-winding textile machine in accordance with claim 1, characterized in that an auxiliary cooling device is provided for supplementary cooling of the housing.

7. A cheese-winding textile machine in accordance with claim 6, characterized in that the auxiliary cooling device operates pneumatically.

8. A cheese-winding textile machine in accordance with claim 5, characterized in that the sensor device is connected to a bobbin winding head computer which controls a valve for activating a supplementary cooling device.

* * * * *